US006439977B1

(12) United States Patent
Quek

(10) Patent No.: US 6,439,977 B1
(45) **Date of Patent: *Aug. 27, 2002**

(54) ROTATIONAL SLURRY DISTRIBUTION SYSTEM FOR ROTARY CMP SYSTEM

(75) Inventor: (Sebastian) Ser Wee Quek, Singapore (SG)

(73) Assignee: Chartered Semiconductor Manufacturing Ltd., Singapore (SG)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/206,735

(22) Filed: Dec. 7, 1998

(51) Int. Cl.[7] ..... B24B 1/00
(52) U.S. Cl. ..... 451/60; 451/446
(58) Field of Search ..... 451/36, 37, 41, 451/60, 28, 98, 99, 446

(56) References Cited

U.S. PATENT DOCUMENTS 3,110,992 A * 11/1963 Keefe ..... 51/263
4,490,948 A * 1/1985 Hanstein et al. ..... 51/358
4,704,826 A * 11/1987 Kirkland ..... 51/411
5,245,794 A 9/1993 Salugsugan
5,643,406 A * 7/1997 Shimomura et al. ..... 156/636.1
5,679,063 A * 10/1997 Kimura et al. ..... 451/287
5,700,181 A * 12/1997 Hashish et al. ..... 451/40
5,702,291 A * 12/1997 Isobe ..... 451/41
5,716,264 A * 2/1998 Kimura et al. ..... 451/443
5,738,573 A 4/1998 Yueh
5,775,983 A 7/1998 Shendon et al.
5,921,849 A * 7/1999 Kim et al. ..... 451/60
6,062,964 A * 5/2000 Chen et al. ..... 451/446

* cited by examiner

*Primary Examiner*—Timothy V. Eley
*Assistant Examiner*—Dung Van Nguyen
(74) *Attorney, Agent, or Firm*—George O. Saile; Rosemary L.S. Pike

(57) ABSTRACT

An apparatus for slurry distribution during semiconductor wafer polishing operations. The slurry is gravity fed or fed under pressure and broadcast under an angle across the entire face of the polishing pad by either a rotating slurry nozzle arrangement or by a rotating slurry shaft arrangement. This as opposed to the conventional slurry supply lines, which are stationary in design.

4 Claims, 2 Drawing Sheets

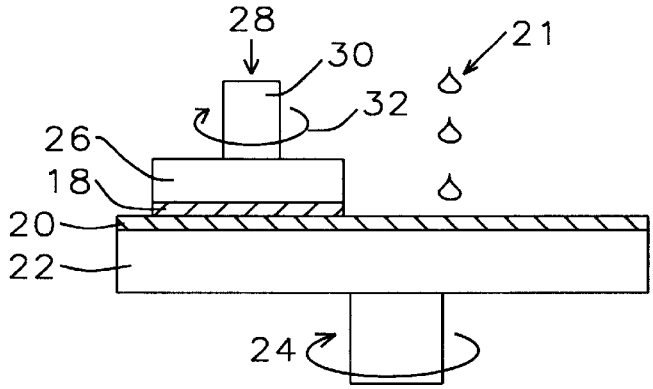
FIG. 1 – Prior Art
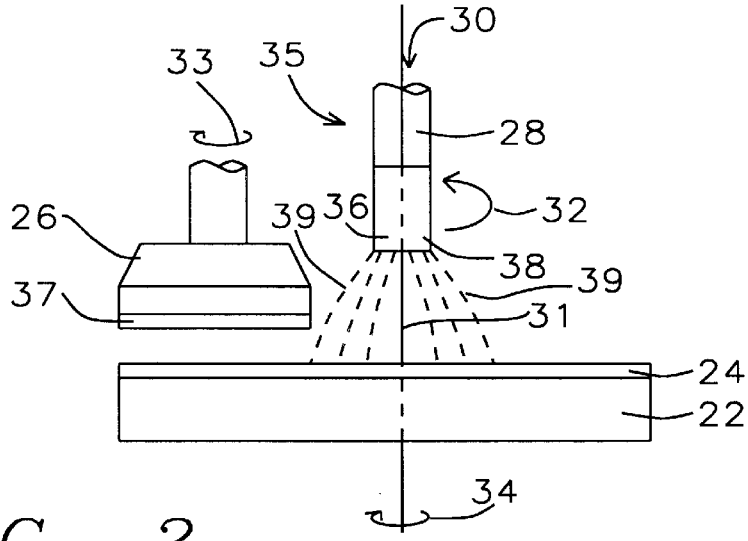
FIG. 2
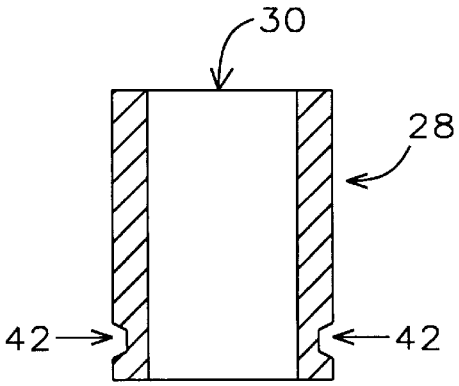
FIG. 3A
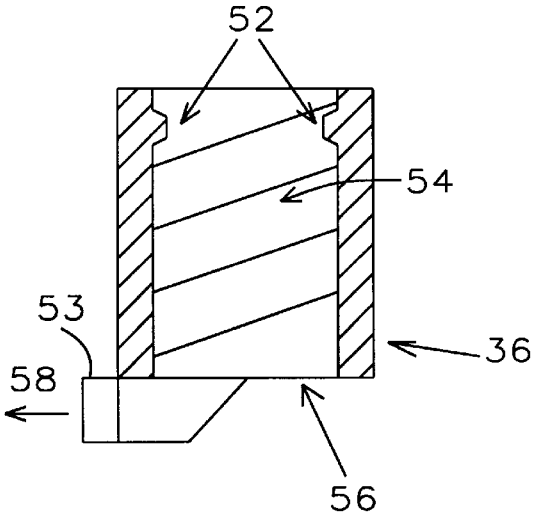
FIG. 3B

ROTATIONAL SLURRY DISTRIBUTION SYSTEM FOR ROTARY CMP SYSTEM

FIELD OF THE INVENTION

The present invention relates to the field of Chemical Mechanical Polishing (CMP). More particularly, the present invention relates to methods and apparatus for chemical mechanical polishing of substrates, such as semiconductor substrates, on a rotating polishing pad in the presence of a chemically and/or physically abrasive slurry, and providing fresh supply of slurry onto the surface of the substrate which is mounted on the polishing pad while the substrate is being polished.

DESCRIPTION OF THE PRIOR ART

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials therein, is maintained on the polishing pad to modify the polishing characteristics of the polishing pad in order to enhance the polishing of the substrate.

The use of chemical mechanical polishing to planarize semiconductor substrates has not met with universal acceptance, particularly where the process is used to remove high elevation features created during the fabrication of microelectronic circuitry on the substrate. One primary problem which has limited the used of chemical mechanical polishing in the semiconductor industry is the limited ability to predict, much less control, the rate and uniformity at which the process will remove material from the substrate. As a result, CMP is labor intensive process because the thickness and uniformity of the substrate must be constantly monitored to prevent overpolishing or inconsistent polishing of the substrate surface.

One factor, which contributes to the unpredictability and non-uniformity of the polishing rate of the CMP process, is the non-homogeneous replenishment of slurry at the surface of the substrate and the polishing pad. The slurry is primarily used to enhance the rate at which selected materials are removed from the substrate surface. As a fixed volume of slurry in contact with the substrate reacts with the selected materials on the surface of the substrate, this fixed volume of slurry becomes less reactive and the polishing enhancing characteristics of that fixed volume of slurry is significantly reduced. One approach to overcoming this problem is to continuously provide fresh slurry onto the polishing pad.

This approach presents at least two problems. Because of the physical configuration of the polishing apparatus, introducing fresh slurry into the area of contact between the substrate and the polishing pad is difficult. Providing a fresh supply of slurry to all positions of the substrate is even more difficult. As a result, the uniformity and the overall rate of polishing are significantly affected as the slurry reacts with the substrate.

Current practice uses a straight line tubing arrangement to dispense the slurry directly into the center of the polishing pad. This leads to uneven distribution of the slurry onto the polishing pad while covering the entire polishing pad with slurry requires a significant amount of time. Current practice therefore leads to higher usage of slurry and longer process time since the polishing process can only start after the entire polishing pad has been covered with slurry.

The polishing process is carried out until the surface of the wafer is ground to a highly planar state. During the polishing process, both the wafer surface and the polishing pad become abraded. After numerous wafers have been polished, the polishing pad becomes worn to the point where the efficiency of the polishing process is diminished and the rate of removal of material from the wafer surface is significantly decreased. It is usually at this point that the polishing pad is treated and restored to its initial state so that a high rate of uniform polishing can once again be obtained.

FIG. 1 shows a Prior Art CMP apparatus. A polishing pad 20 is affixed to a circular polishing table 22 which rotates in a direction indicated by arrow 24 at a rate in the order of 1 to 100 m RPM. A wafer carrier 26 is used to hold wafer 18 face down against the polishing pad 20. The wafer 18 is held in place by applying a vacuum to the backside of the wafer (not shown). The wafer carrier 26 also rotates as indicated by arrow 32, usually in the same direction as the polishing table 22, at a rate on the order of 1 to 100 RPM. Due to the rotation of the polishing table 22, the wafer traverses a circular polishing path over the polishing pad 20. A force 28 is also applied in the downward vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26. Slurry 21 is provided to the top of the polishing pad to further enhance the polishing action of polishing pad 20.

U.S. Pat. No. 5,775,983 (Shendon et al.) shows a conical roller pad.

U.S. Pat. No. 5,738,573 (Yueh) shows a slurry distribution method with slurry distribution in the core. However, this reference differs from the present invention.

U.S. Pat. No. 5,245,794 (Salusugan) shows a conventional slurry tube.

SUMMARY OF THE INVENTION

The present invention teaches a gravity fed slurry distribution system. Slurry is fed to the polishing pad via a slurry tube. The slurry tube of the present invention rotates; this rotation of the slurry tube is caused by a special design of the outlet of the slurry tube that dispenses the slurry onto the polishing pad. The rotation of the slurry tube outlet is in a direction that is opposite to the direction of rotation of the polishing pad. This allows for quick and efficient broadcasting of the slurry across the entire surface of the polishing pad.

BRIEF DESCRIPTION OF THE DRAWING

FIG. 1 shows a Prior Art CMP apparatus.

FIG. 2 shows an overview of the implementation of the present invention with the relative positioning of the polishing table, the polishing pad, the wafer carrier and the slurry distribution tube.

FIG. 3*a* and FIG. 3*b* show the design of the outlet of the rotating slurry distribution tubing.

DETAILED DESCRIPTION OF THE PREFERRED EMBODIMENT

In the first embodiment of the present invention the means of distributing slurry evenly across the surface of a polishing pad consists of a slurry feed tubing arrangement whereby the last orb lowest section of this arrangement rotates and in so doing distributes the slurry over the face of the polishing pad. FIG. 3*a* and FIG. 3*b* address the first embodiment of the present invention.

Figure 4A:
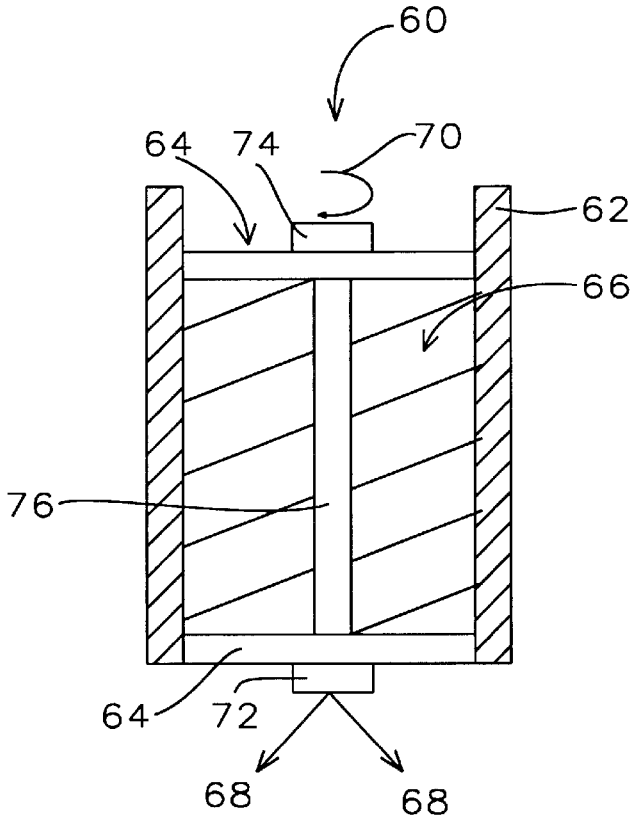
FIGS. 4*a* and 4*b* show cross sections of an alternate implementation of the present invention.
Figure 4B:
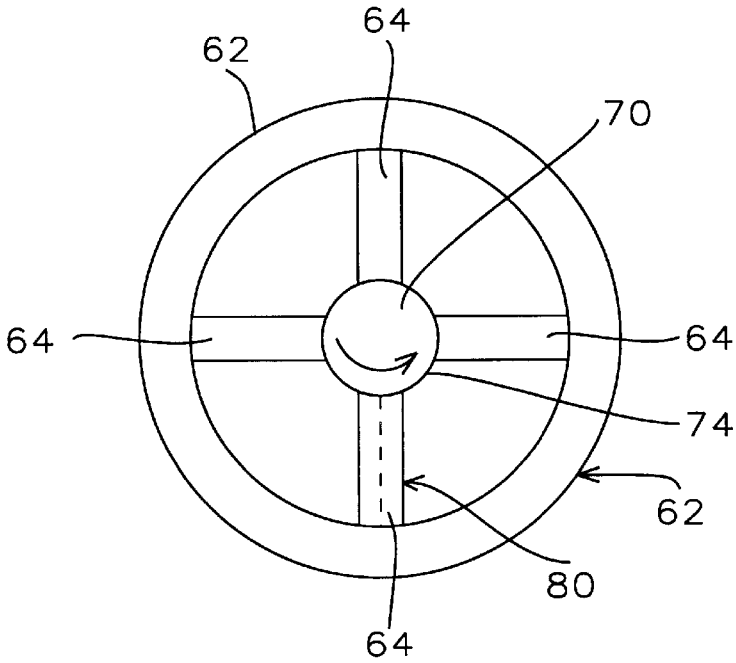

In the second embodiment of the present invention the means of distributing slurry evenly across the surface of a polishing pad consists of a rotating shaft contained within the slurry supply reservoir. FIG. 4*a* and FIG. 4*b* address the second embodiment of the present invention.

First Embodiment of the Present Invention

Referring now specifically to FIG. 2, there is shown an overview of the implementation of the present invention with the relative positioning of the polishing table 22, the polishing pad 24, the wafer carrier 26 and the slurry supply tube 35. One polishing pad 24 is shown, however a set of more than one abrasive polishing pads having a suspension medium can be used. The slurry supply tube 35 consists of two sections, the upper section 28 which is fixed or stationary in position and the lower section 36 which rotates around its axis 31 which is also the axis of the stationary slurry tube 28. The wafer-polishing table rotates in direction 34; the lower section 36 of the slurry supply tube 35 rotates in direction 32, the wafer carrier rotates in direction 33. The wafer carrier holds wafer 37 in place. Note that directions 34 and 32 are in opposite directions. The slurry is fed into the slurry supply tube 35 at point 30; the slurry gravity feeds down through the stationary upper section 28 and the rotating lower section 36 and exits the lower section 36 at point 36. The slurry spay 39 is, due to the counter directive rotations of the lower section 36 and the wafer polishing table 22, that is 32 and 34, efficiently broadcast and distributed across the surface of the wafer polishing pad 24.

FIG. 3 provides further detail of the construction of the slurry supply tube 35. FIG. 3*a* shows the cross section of the stationary upper section 28 of the slurry supply tube 35. FIG. 3*b* shows a cross section of the rotating lower section 36 of the slurry supply tube 35. The slurry 30 enters upper section 28 at the top of section 28 and gravity flows down through the tube 28. The concave section 42 provided at outside surface of the lower portion of tube 28 matches the convex section 52 provided at the inside surface of the upper portion of the rotating section 36 of the slurry supply tube 35. These matching sections 42 and 52 are operationally combined by affixing the concavity of 42 within the convexity of 52, this affixing is done in such a manner that the two sections, that is the stationary and the rotating sections, exhibit little or no motion with respect to each other in the vertical or Z direction while the two sections maintain freedom of rotation with respect to each other around the axis of rotation 31. The gravity fed slurry 30 is, on its downward path, routed through a channel 54 of spiral shape within the inside of the rotating section 36 thus causing and maintaining the rotation of this section 36. By providing a seal 56 within section 36 across the lower extremity of 36 and in a plane perpendicular to the axis 31 of lower section 36, the slurry is prevented from exiting section 36 in the direction of its axis 31. The exit spout 53 forces the slurry 30 to exit (58) section 36 under an angle with its axis 31 thus causing section 36 to rotate around its axis 31.

Second Embodiment of the Present Invention

FIG. 4*a* shows and alternate method of implementing the rotational aspect of the slurry distribution arrangement. The slurry 60 enters the slurry reservoir 62 and is forced to flow through a channel 66, which is shaped in the form of a spiral. The downward or Z-axis directional motion of the slurry 60 is in this manner translated into a rotational motion 70, which is transferred to a rotational motion of a shaft 76. The shaft 76 is held in a fixed or stationary position with respect to the slurry reservoir 62 by means of two membranes 64 within the reservoir 62. The shaft 76 does however have freedom of rotation 70 within these membranes 64. An opening or exit point provided within the bottom part 72 of shaft 76 allows the slurry to escape as indicated by 68. This opening is provided under an angle with respect to the X-Y-Z direction forcing the slurry to be broadcast or distributed across the surface of the polishing pad and to impact this surface under and angle. This angle which can be selected and designed to suit any particular application of the present invention.

FIG. 4*b* shows a top plan view of the implementation of the second embodiment of the present invention. Indicator 80 further highlights that the slurry reservoir 62 and the membranes 64 within this reservoir are stationary while the head 74 of shaft 76 has freedom of rotation 70.

The invention, which provides a method for chemical mechanical planarization of a semiconductor wafer, can be summarized as follows:

- a rotating platform is provided for mounting semiconductor wafers over the surface thereof
- a rotating platform is provided for mounting semiconductor polishing pads over the surface thereof
- a means is provided for evenly distributing slurry across a polishing pad, this means comprising a slurry supply shaft which is mounted within a slurry supply reservoir and wherein a lower extremity of a rotating slurry supply shaft has a means for distributing the slurry, the means for distributing the slurry comprising at least one opening in a lower extremity of the rotating slurry supply shaft whereby downward motion of the slurry is transformed into a rotating motion of the rotating slurry supply shaft, the means for distributing the slurry can further use pressure applied to the slurry while the slurry exits the rotating slurry supply shaft, and
- a means is provided for controlling rate of slurry flow.

The means for distributing the slurry comprises a multiplicity of openings in a lower extremity of a rotating slurry supply shaft wherein the direction of the axis of the openings does not coincide with the X-Y-Z direction of the rotating slurry supply shaft.

From the foregoing it will be clear that, although a specific embodiment of the present invention has been described herein for purposes of illustration, various modifications to the present invention may be made without deviating from the spirit and scope of the present invention. Accordingly, the present invention is not limited except as by the appended claims.

What is claimed is:

1. A method for chemical mechanical planarization of a semiconductor wafer, comprising:

providing a rotating platform for mounting semiconductor wafers;

providing a rotating platform for mounting semiconductor polishing pads;

providing a means for evenly distributing slurry across a polishing pad comprising a slurry supply shaft which is mounted within a slurry supply reservoir and wherein a lower extremity of a rotating slurry supply shaft has a means for distributing said slurry, said means for distributing said slurry comprising at least one opening in a lower extremity of said rotating slurry supply shaft whereby downward motion of said slurry is transformed into a rotating motion of said rotating slurry supply shaft; and providing a means for controlling rate of slurry flow.

2. The method of claim 1 wherein said means for distributing said slurry uses pressure applied to said slurry while said slurry exits said rotating slurry supply shaft.

3. The method of claim 1 wherein said means for distributing said slurry comprises a multiplicity of openings in the lower extremity of the rotating slurry supply shaft wherein the direction of the axis of said openings does not coincide with the X-Y-Z direction of said rotating slurry supply shaft.

4. The method of claim 3 wherein said means for distributing said slurry comprises pressure applied to said slurry during said distribution of said slurry.

* * * * *